United States Patent [19]

Hunter

[11] 4,198,000

[45] Apr. 15, 1980

[54] STREAM ROTOR SPRINKLER WITH ROTATING DEFLECTORS

[75] Inventor: Edwin J. Hunter, Rancho Santa Fe, Calif.

[73] Assignee: The Toro Company, San Marco, Calif.

[21] Appl. No.: 784,051

[22] Filed: Apr. 4, 1977

[51] Int. Cl.[2] ..... B05B 3/10

[52] U.S. Cl. ..... 239/222.13; 239/206; 239/232

[58] Field of Search ..... 239/206, 222.13, 231, 239/232, 240, 237, 241, DIG. 1

[56] References Cited

U.S. PATENT DOCUMENTS

| | | | |
|---|---|---|---|
| 1,480,507 | 1/1924 | Coblentz et al. | 239/240 |
| 1,760,903 | 6/1930 | Henkel | 239/240 |
| 3,464,628 | 9/1969 | Ho Chow | 239/232 |
| 3,727,842 | 4/1973 | Ertsgaard et al. | 239/232 |

*Primary Examiner*—Robert W. Saifer

*Attorney, Agent, or Firm*—Poms, Smith, Lande & Rose

[57] ABSTRACT

A stream rotor sprinkler having a rotatable nozzle assembly for discharging a stream of fluid, and a rotatable plurality of deflectors mounted to the sprinkler surrounding the nozzle assembly. A water-driven motor impeller is activated by fluid flow through the sprinkler and rotates an attached rotor. The nozzle assembly is integrally attached to the rotor and is rotated thereby. The nozzle assembly includes an annular skirt at its lower end; the deflectors also have an integrally attached annular skirt which is in horizontal concentric relationship with the nozzle assembly skirt. A transmission is mounted to the sprinkler so as to be positioned between the deflector skirt and the nozzle assembly skirt. The transmission is driven by the rotation of the nozzle assembly skirt and in turn rotates the deflector skirt. The nozzle assembly rotates at an angular velocity different than the angular velocity of the deflectors so that the deflectors are not in the same position when the nozzle returns to a given position so that the circumferential coverage of fluid is substantially uniform.

18 Claims, 4 Drawing Figures

II
50
12
14
21
11
19
21b
27
13
21a
10
16
II
23
29
24
15
15
34
33
32
32
26
31
17
18

Fig. 2.
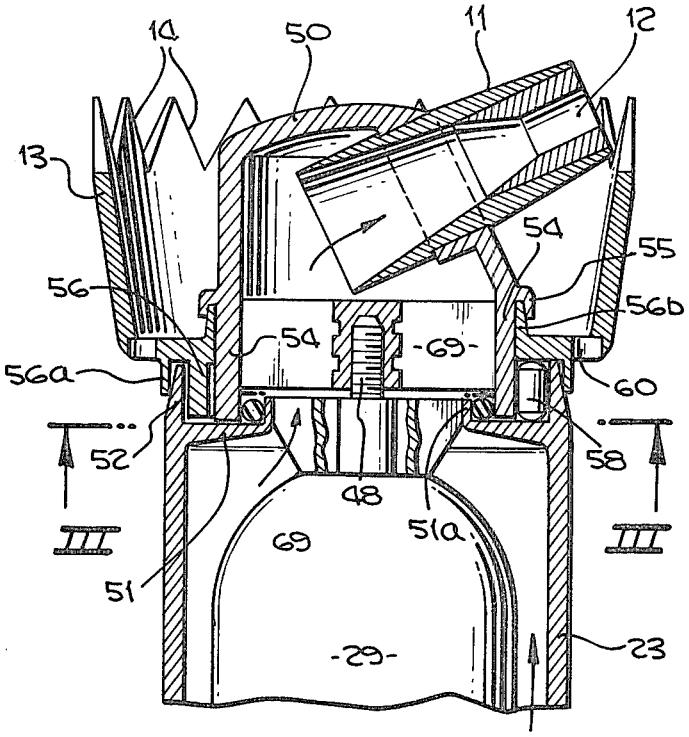
Fig. 4.
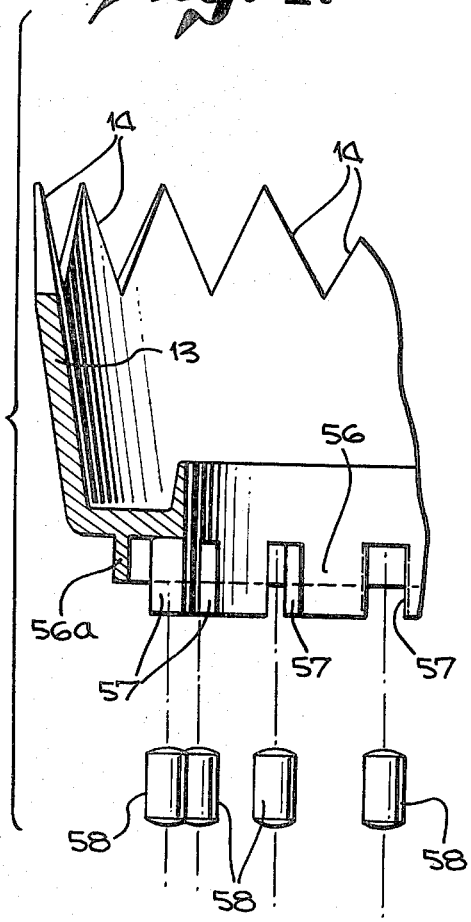
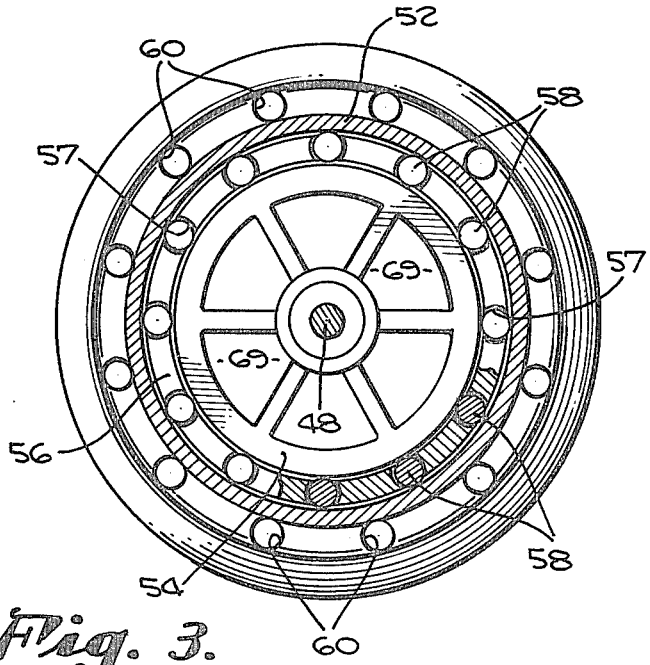
Fig. 3.

STREAM ROTOR SPRINKLER WITH ROTATING DEFLECTORS

BACKGROUND OF THE INVENTION

1. Field of the Invention

This invention relates to sprinklers, particularly moving discharge sprinklers, and more particularly to moving discharge sprinklers having moving deflectors.

2. Description of the Prior Art

Commercial and residential water sprinklers may be generally classified as either fixed or moving discharge sprinklers. A typical fixed discharge sprinkler has a stationary sprayhead which directs either a number of discrete diverging streams of water, or a continuous fan spray of water spreading outwardly from the sprayhead over a fixed angle which may range from a few degrees to 360°, depending on the area desired to be sprayed. A moving discharge sprinkler, on the other hand, has a movable sprayhead, which directs one or more water streams outwardly from a nozzle assembly which is driven in a rotary, oscillatory, or other cyclic motion to cause the water streams to sweep over the area to be covered.

In my U.S. Pat. No. 2,909,325, I disclosed a moving discharge sprinkler system wherein sprinkler heads of the pop-up type are utilized. In that system, a small water turbine wheel rotating at relatively high speed causes rotation of the sprinkler nozzle assembly. In my U.S. Pat. No. 3,854,664, I disclose an improvement of my previous patent which provides for a transmission system for transmitting rotation from the turbine wheels to the nozzle assembly.

In many moving discharge sprinklers, a plurality of nozzles has been required to obtain a satisfactory radial coverage of the spray area, but with a concommitant undesired increase in the precipitation rate.

In other moving discharge sprinklers, single nozzle assemblies have been employed with deflector means used to breakup the single fluid stream. In these moving discharge sprinklers, the deflector means and the nozzle assembly have each been separately driven by gear connections to the transmission. This has resulted in quite complex gear assemblies. In addition, it is especially important to ensure that the intermittent deflector means and the nozzle assembly rotate at different angular velocities so that the fluid stream will not remain in the same position relative to the rotating deflector means. This also has necessitated complex gear mechanisms.

It is therefore the primary object of this invention to provide a stream rotor sprinkler having a stream discharging nozzle assembly and a rotating intermittent deflector means which is not directly operated by the motor transmission so as to provide a simpler operating stream rotor sprinkler.

Another object of this invention is to provide a stream rotor sprinkler having a rotating nozzle assembly, and a rotating deflector which is driven by the rotating nozzle assembly.

Yet another object of this invention is to provide a stream rotor sprinkler having a rotating nozzle assembly and a rotating deflector which rotate at different angular velocities.

Still another object of this invention is to provide a stream rotor sprinkler having a deflector means so as to provide substantially uniform circumferential fluid coverage.

Further objects of the present invention will become apparent to those skilled in the art from the description of the invention found hereinafter.

SUMMARY OF THE INVENTION

The present invention relates to a stream rotor sprinkler having a fluid dispensing nozzle assembly mounted on a rotor driven by a motor, fluid stream deflectors rotatably mounted to the sprinkler about said nozzle assembly, and a transmission mounted to said sprinkler, driven by the rotation of the nozzle assembly and adapted to rotate the deflectors.

In the preferred embodiment, the stream rotor sprinkler includes a cylindrical member housing a motor, said housing having an inwardly radial annular flange at its top and having an axial annular flange extending from said member above said radial flange; a rotor attached to and driven by said motor; a nozzle assembly rotatably mounted to said rotor and having an integrally attached annular skirt which is horizontally concentric with the axial flange so that the axial flange, the radial flange, and the nozzle assembly skirt define an annular race; a plurality of integrally attached fluid stream deflectors rotatably mounted to said sprinkler about said nozzle assembly, said deflectors having an integrally attached annular deflector skirt disposed between and in horizontal concentric relationship with said nozzle assembly skirt and the axial flange; said deflector skirt having means for carrying a plurality of rolling members whose rolling surfaces are in rolling contact with the nozzle assembly skirt and in rolling contact with the axial flange so that as the nozzle skirt rotates, the rolling members are caused to roll relative to the axial flange and thereby cause the deflector skirt to rotate. This simple construction, without the necessity of gears, will ensure that the deflectors and the nozzle assembly will rotate at different angular velocities so that the sprinkler can provide substantially uniform circumferential fluid coverage.

A more complete and thorough understanding of the stream rotor sprinkler of this invention will be afforded those skilled in the art from a consideration of the following detailed description of the invention when considered in conjunction with the accompanying drawings.

BRIEF DESCRIPTION OF THE DRAWINGS

FIG. 2 is a detail view of the sprayhead and nozzle assembly of FIG. 1 taken along of plane of II—II;

FIG. 3 is a horizontal view of the sprayhead and transmission means of FIG. 2 taken along the plane of III—III; and FIG. 4 is a partial detail cross-sectional view of the deflector means and the rolling members of the transmission means.

DETAILED DESCRIPTION OF THE INVENTION

Figure 1:
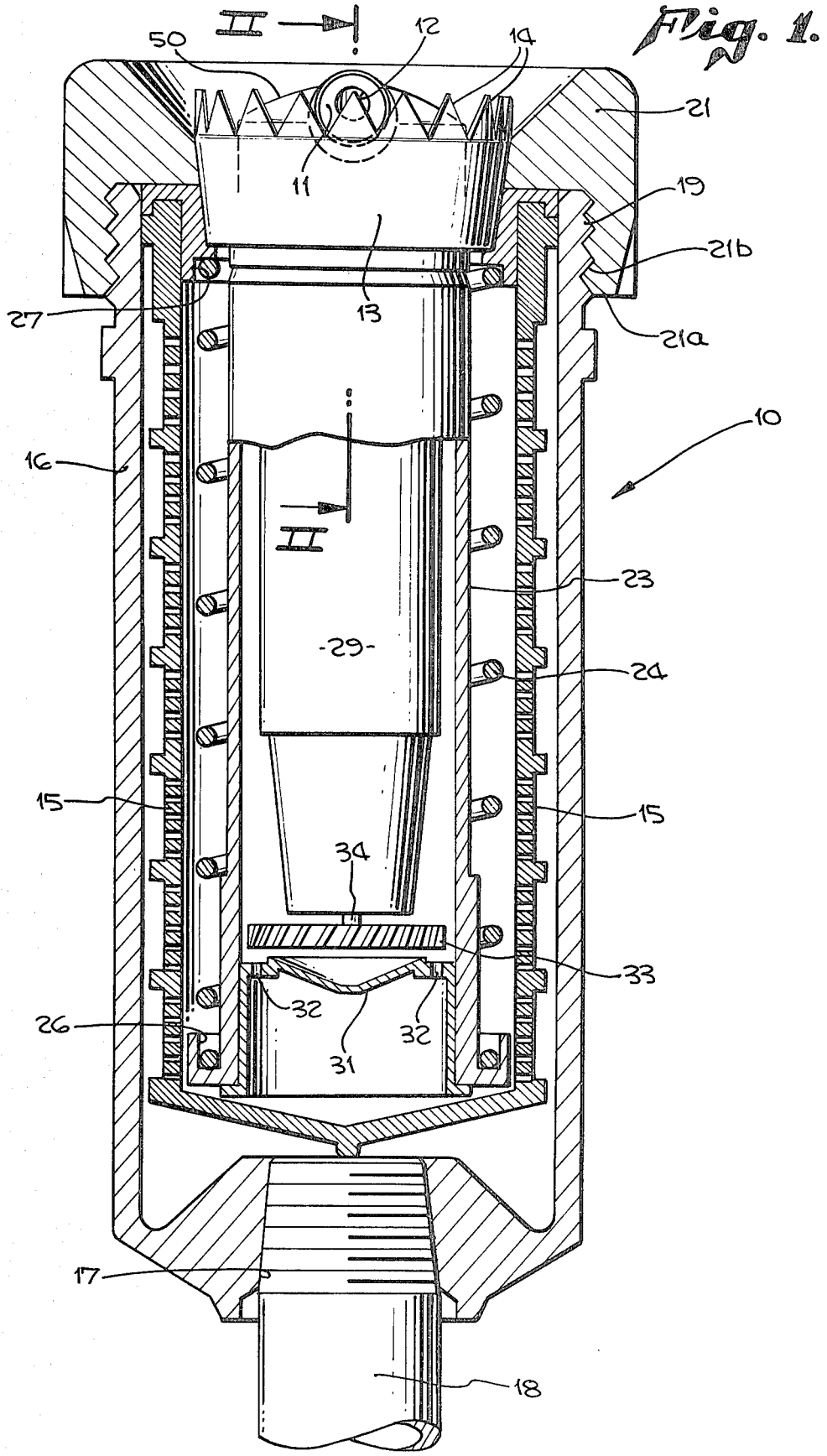
FIG. 1 is a side-elevational view, partly in section of an exemplary embodiment of the stream rotor sprinkler of this invention.

Referring now to FIG. 1 of the drawings, a sprinkler 10 is shown having a rotatable nozzle 11 for discharging a stream of fluid through an orifice 12. A rotatable deflector assembly 13 is positioned around the nozzle 11 as shown in greater detail in FIG. 2. The deflector assembly has a plurality of vertically extending fingers 14 which will intermittently intersect the trajectory of the fluid stream discharged from the nozzle 11. As will be explained hereinafter, the fluid stream discharged through orifice 12 of nozzle 11 is intermittently interrupted by the fingers 14 of the deflector assembly 13 at varying angular positions to provide a substantially uniform circumferential and radial coverage of the fluid discharged from the orifice 12.

The sprinkler 10 has an outer generally cylindrical housing 16 which is reduced at its lower end and internally threaded to form a water inlet 17; a water supply line 18 is threaded therein as shown. The upper end of the housing 16 is open and includes threads 19 on the upper outer periphery thereof. A cap 21, having a downwardly extending marginal flange 21*a* with threads 21*b* on the inner periphery thereof is threadably attached onto the threads 19 as shown.

The sprinkler has a riser 23 slidably mounted within the housing 16 and arranged to protrude from the cap 21 when the riser 23 is lifted up due to water pressure from the water supply line 18. The riser 23 is normally biased downwardly by a spring 24 which is mounted at the bottom in a channel 26 in the riser 23, and at the top in a channel 27 in the cap 21 as shown in FIG. 1. A screen 15 may be arranged around the riser 23 to filter the stream of water supplied by the water supply line 18. The screen may be a basket-type screen or a disc type screen as described more fully in my U.S. Pat. No. 3,854,664.

The rotation of the nozzle assembly is imparted by a transmission system mounted in a transmission housing 29 which is secured to the housing 23 by ribs (not shown) which are axially disposed around the inner surface of housing 23. A dish-shaped member 31 is mounted at the lower portion of the transmission housing and has apertures 32 formed therethrough. An impeller 33 is mounted just above the dish-shaped member 31 and has impeller blades formed thereon. The impeller 33 receives a transmission shaft 34 for transmitting rotational energy to the transmission gears. The flow of fluid through the water supply line 18, the screen 15, and apertures 32 causes the impeller 33 to rotate, thereby imparting rotational energy through transmission shaft 34 to rotor 48 (FIG. 2) and to the nozzle assembly as is more fully explained in my U.S. Pat. No. 3,854,664.

The transmission housing 29 is supported by a plurality of ribs described hereinabove and the fluid which enters the water inlet 17 from the water supply line 18 flows past the impeller 33, between the ribs, and through the water inlets 69 (FIG. 2), and finally through orifice 12 of the nozzle 11.

Referring now particularly to FIG. 2, the nozzle assembly comprises a cap 50 which has the nozzle 11 integrally attached thereto. The nozzle assembly further includes an integrally attached annular skirt 54 which extends downwardly from the top of the cap 50. Between the annular skirt 54 and the top portion of the cap 50 is a downwarding-directed lip 55 which circumvents the nozzle assembly. The nozzle assembly is preferably made of a plastic material such as DELRIN, the trademark for an acetal resin marketed by DuPont.

The housing 23 includes an inwardly radial annular flange 51 having an upturned annular lip 51*a*. Disposed between the nozzle skirt 54 and the lip 51*a* is an O-ring which seals the internal cavity of the cap 50 to prevent the loss of fluid. Extending upwardly from said radial flange 51 is an annular axial flange 52.

The deflector assembly 13 is essentially an upwardly-directed cup-shaped member having an integrally attached annular deflector skirt 56 which extends downwardy in an axial direction. Spaced radially outwardly from the annular deflector skirt 56 is a down-turned annular deflector lip 56*a* which is adapted to be in sliding engagement with the outer surface of the housing axial flange 52. The deflector assembly also includes an upturned annular lip 56*b* which is disposed radially inwardly from the deflector skirt 56. This lip 56*b* is adapted to be received within a channel defined by the nozzle lip 55 and the nozzle skirt 54, and adapted to slideably engage said channel so as to guide and retain the deflector as it rotates relative to the nozzle assembly. The deflector is preferrably made of a high impact plastic, such as CYCLOLAC which is the trademark of Borg Warner for an ABS material. It is also preferred that the deflector assembly be provided with orifices at the bottom portion of the cup-shaped assembly to allow for the drainage of water which may collect in the cup-shaped deflector.

The nozzle skirt 54, the housing axial flange 52, and the housing radial flange 51 define an annular channel or race within which the deflector skirt 56 is received and rotates within.

The transmission which imparts rotational movement to the deflector assembly is adapted to be driven by the rotation of the nozzle assembly. In the preferred embodiment, the deflector skirt 56 is provided with a plurality of axial openings or partial cylindrical slots 57 which are adapted to receive a plurality of rolling members 58. These elements are best seen in FIGS. 3 and 4. The deflector skirt 56 functions as a cage in which the rolling members are encased but yet allowed to freely rotate. The rolling members are preferrably cylinders with rounded ends, and made of a slip resistant material, such as rubber. The rolling members are adapted and sized so as to contact the inner surface of the housing axial flange 52 and to contact the outer surface of the nozzle skirt 54.

In operation, the nozzle assembly and therefore the nozzle skirt 54 are rotatively driven by the rotor 48 which is integrally attached to the nozzle assembly. As the nozzle skirt 54 rotates, it is in non-sliding contact with the rolling members 58 and cause said rolling members to rotate. Because the rolling members are in non-sliding contact with the housing axial flange 52, the rotation of the rolling members will cause them to roll along the inner surface of the axial flange 52 and thereby push the deflector skirt 56 along with them in the same direction. Due to the geometrical arrangement of these elements, the deflector assembly will have an angular velocity one-half the angular velocity of the nozzle assembly (assuming no slippage of the rolling members along their contact surfaces). This is because the center of the rolling member has a translatory velocity one-half the velocity of the nozzle skirt.

It is apparent from this description that there is provided a simple mechanical means of providing a rotating deflector and rotating nozzle which will rotate at different angular velocities.

While there has been shown and described what is at present considered the preferred embodiment of the invention, it is obvious to those skilled in the art that various changes and modifications may be made therein without departing from the invention as defined by the appended claims.

I claim:

1. A stream rotor sprinkler having a fluid dispensing nozzle assembly mounted on a rotor driven by a motor wherein the improvement comprises the provision of:

fluid stream deflectors rotatably mounted to said sprinkler about said nozzle assembly and adapted to be continuously driven by said nozzle assembly.

2. The sprinkler defined in claim 1 wherein the angular velocity of the nozzle assembly is not equal to the angular velocity of the deflectors so that as the deflectors and nozzle assembly rotate the area sprayed receives a substantially circumferentially uniform fluid coverage.

3. A stream rotor sprinkler having a fluid dispensing nozzle assembly mounted on a rotor driven by a motor wherein the improvement comprises the provision of:

fluid stream deflectors rotatably mounted to said sprinkler about said nozzle assembly and adapted to be continuously driven by said nozzle assembly;

wherein the angular velocity of the nozzle assembly is about twice the angular velocity of the deflectors so that as the deflectors and nozzle assembly rotate, the area sprayed receives a substantially circumferentially uniform fluid coverage.

4. The sprinkler defined in claim 3 wherein:

said nozzle assembly has an integrally attached annular skirt;

said deflectors have an integrally attached annular skirt in horizontal concentric relationship with the nozzle assembly skirt; and further including a transmission being disposed so as to be driven by the rotation of the nozzle assembly skirt and to continuously rotatably drive the deflector skirt.

5. A stream rotor sprinkler having a fluid dispensing nozzle assembly mounted on a rotor driven by a fluid powered motor operated by fluid flow through said sprinkler, wherein the improvement comprises the provision of:

a plurality of integrally attached fluid stream deflectors rotatably mounted to said sprinkler about said nozzle assembly and adapted to be continuously driven by the nozzle assembly; and a transmission rotatably mounted to said sprinkler to be rotated by the rotation of the nozzle assembly, and said transmission being operatively connected to said deflectors for continuously rotating said deflectors for the intermittent deflection of the fluid streams.

6. The sprinkler defined in claim 5 wherein the angular velocity of the nozzle assembly is not equal to the angular velocity of the deflectors so that as the deflectors and nozzle assembly rotate the area sprayed receives a substantially circumferentially uniform fluid coverage.

7. A stream rotor sprinkler having a fluid dispensing nozzle assembly mounted on a rotor driven by a fluid powered motor operated by fluid flow through said sprinkler, wherein the improvement comprises the provision of:

a plurality of integrally attached fluid stream deflectors rotatably mounted to said sprinkler about said nozzle assembly and adapted to be continuously driven by the nozzle assembly; and a transmission rotatably mounted to said sprinkler to be rotated by the rotation of the nozzle assembly, and said transmission being operatively connected to said deflectors for continuously rotating said deflectors for the intermittent deflection of the fluid streams;

wherein the angular velocity of the nozzle assembly is about twice the angular velocity of the deflectors so that as the deflectors and nozzle assembly rotate the area sprayed receives a substantially circumferentially uniform fluid coverage.

8. The sprinkler defined in claim 7 wherein:

said nozzle assembly has an integrally attached annular skirt;

said deflectors have an integrally attached annular skirt in horizontal concentric relationship with the nozzle assembly skirt; and said transmission being disposed so as to be driven by the rotation of the nozzle assembly skirt and to rotatably drive the deflector skirt.

9. A stream rotor sprinkler having a fluid dispensing nozzle assembly mounted on a rotor driven by a fluid powered motor operated by fluid flow through said sprinkler, wherein the improvement comprises:

said nozzle assembly having an integrally attached annular skirt;

a plurality of integrally attached fluid stream deflectors rotatably mounted to said sprinkler about said nozzle assembly, said deflectors having an integrally attached annular deflector skirt in horizontal concentric relationship with the nozzle assembly skirt; and a plurality of rolling members carried by said deflector skirt whose rolling surfaces are in rolling contact with the nozzle skirt so that as the nozzle assembly rotates, the rolling members are caused to roll and cause the deflectors to rotate.

10. The sprinkler defined in claim 9 wherein the angular velocity of the nozzle assembly is not equal to the angular velocity of the deflectors so that as the deflectors and nozzle assembly rotate the area sprayed receives a substantially circumferentially uniform fluid coverage.

11. The sprinkler defined in claim 10 wherein the angular velocity of the nozzle assembly is about twice the angular velocity of the deflectors.

12. A stream rotor sprinkler having a fluid dispensing nozzle assembly mounted on a rotor driven by a fluid powered motor operated by fluid flow through said sprinkler, wherein the improvement comprises:

deflector means for intermittently deflecting the fluid stream;

means for mounting said deflector means to said sprinkler for movement about said nozzle assembly;

means for continuously moving said deflector means, said moving means being actuated by the movement of the nozzle assembly.

13. The sprinkler defined in claim 12 wherein the angular velocity of the nozzle assembly is not equal to the angular velocity of the deflector means so that as the deflector means and nozzle assembly rotate, the area sprayed receives a substantially circumferentially uniform fluid coverage.

14. A stream rotor sprinkler having a fluid dispensing nozzle assembly mounted on a rotor driven by a fluid powered motor operated by fluid flow through said sprinkler, wherein the improvement comprises:

deflector means for intermittently deflecting the fluid stream;

means for mounting said deflector means to said sprinkler for movement about said nozzle assembly;

means for continuously moving said deflector means, said moving means being actuated by the movement of the nozzle assembly;

wherein the angular velocity of the nozzle assembly is about twice the angular velocity of the deflector means so that as the deflector means and nozzle assembly rotate, the area sprayed receives a substantially circumferentially uniform fluid coverage.

15. The sprinkler defined in claim 14 wherein:

said nozzle assembly has an integrally attached annular skirt;

said deflector means has an integrally attached annular skirt in horizontal concentric relationship with the nozzle assembly skirt; and said means for moving the deflector means being disposed so as to be driven by the rotation of the nozzle assembly skirt and to continuously rotatably drive the deflector means.

16. A stream rotor sprinkler comprising:

a cylindrical housing for enclosing a motor, said housing having an inwardly radial annular flange at its top and having an annular axial flange extending upwardly from said radial flange;

a rotor attached to and driven by said motor;

a nozzle assembly integrally mounted to said rotor and having an integrally attached annular skirt which is horizontally concentric with the axial flange so that the axial flange, the radial flange, and the nozzle assembly skirt define an annular race;

a plurality of integrally attached fluid stream deflectors rotatably mounted to said sprinkler about said nozzle assembly, said deflectors having an integrally attached annular deflector skirt having means for carrying a plurality of rolling members whose rolling surfaces are in rolling contact with the nozzle assembly skirt and in rolling contact with the axial flange so that as the nozzle skirt rotates, the rolling members are caused to roll relative to the axial flange and thereby cause the deflector skirt and the deflectors to rotate; and a plurality of rolling members carried by said deflector skirt.

17. The stream rotor sprinkler defined in claim 16 wherein said means for carrying the rolling members are cylindrical slots circumferentially spaced around said deflector skirt and sized so as to retain the rolling members and to allow them to rotate relative to the deflector skirt.

18. A stream rotor sprinkler having a fluid dispensing nozzle assembly mounted on a rotor driven by a fluid powered motor operated by fluid flow through said sprinkler, wherein the improvement comprises:

deflector means for intermittently deflecting the fluid stream;

means for mounting said deflector means to said sprinkler for movement about said nozzle assembly; and means for moving said deflector means, said moving means being actuated by the movement of the nozzle assembly;

and wherein:

said nozzle assembly has an integrally attached annular skirt;

said deflector means has an integrally attached annular skirt in horizontal concentric relationship with the nozzle assembly skirt; and said means for moving the deflector means being disposed so as to be driven by the rotation of the nozzle assembly skirt and to rotatably drive the deflector means;

and wherein the means for moving the deflector means is integrally attached to the deflector means and includes:

means for carrying a plurality of rolling members; and a plurality of rolling members, each member being simultaneously in rolling contact with the nozzle assembly skirt and with a stationary axial annular flange integral with the sprinkler;

so that as the nozzle assembly rotates, the rolling members are caused to roll relative to the axial annular flange and cause the deflector means to rotate.

* * * * *